US005421500A

United States Patent [19]

Niemann et al.

[11] Patent Number: 5,421,500

[45] Date of Patent: Jun. 6, 1995

[54] DEVICE FOR GUIDING A TRANSVERSELY STABLE WEB

[75] Inventors: Heinrich Niemann, Enger; Hans Wulf, Gutersloh, both of Germany

[73] Assignee: Erhardt & Leimer GmbH, Augsburg, Germany

[21] Appl. No.: 899,430

[22] Filed: Jun. 16, 1992

[30] Foreign Application Priority Data

Jun. 17, 1991 [DE] Germany ..... 9107437 U

[51] Int. Cl.[6] ..... B23Q 16/00; B65H 20/24

[52] U.S. Cl. ..... 226/21; 226/171

[58] Field of Search ..... 226/15, 18, 21, 171, 226/97

[56] References Cited

U.S. PATENT DOCUMENTS

| | | | |
|---|---|---|---|
| 642,141 | 1/1900 | Lyon | 226/15 |
| 4,303,189 | 12/1981 | Wiley et al. | 226/15 |
| 4,334,759 | 6/1982 | Clausing | 226/21 X |
| 4,513,517 | 4/1985 | Vedenpaa | 226/97 X |
| 4,688,784 | 8/1987 | Wirz | 226/97 X |
| 4,726,501 | 2/1988 | Wiley | 226/15 |
| 4,795,070 | 1/1989 | Blanding et al. | 226/15 |
| 4,835,547 | 5/1989 | Ohushi et al. | 226/15 X |
| 4,844,312 | 7/1989 | Gomi et al. | 226/21 |
| 4,960,234 | 10/1990 | Focke | 226/18 X |
| 5,052,296 | 10/1991 | Shiba | 226/45 X |

FOREIGN PATENT DOCUMENTS

| | | |
|---|---|---|
| 0277761 | 8/1988 | European Pat. Off. . |
| 2844528 | 4/1979 | Germany . |
| WO88/01755 | 3/1988 | WIPO . |

*Primary Examiner*—John M. Jillions
*Assistant Examiner*—Michael R. Monsen
*Attorney, Agent, or Firm*—Collard & Roe

[57] ABSTRACT

For guiding webs of paper or cardboard, a guide cylinder extending across half of the web grips onto the surface of the web and achieves moving corrections on the webs by rotation or swinging. The long, linear support zone of the guide cylinder causes a high mechanical stress, whereby the guide cylinder exerts almost no corrective effect in its center zone. By dividing the guide cylinder into at least two spaced-apart, parallel guide rolls having their axes disposed perpendicular to the running direction of the material web, a suitable larger effective area is obtained for correction of the direction of movement.

10 Claims, 2 Drawing Sheets

DEVICE FOR GUIDING A TRANSVERSELY STABLE WEB

BACKGROUND OF THE INVENTION

1. Field of the Invention

The present invention relates to a device for guiding a moving, transversely stable web, in particular a corrugated board web, a corrugated board layer web, a paper web, or a transversely stable foil web.

2. The Prior Art

With a device known from EP-A2-0277761, FIG. 10, for guiding a strip in the winding of transformers, the through-extending guide cylinder extends across approximately half the width of the strip. When, for correction purposes, the guide cylinder is swung, the mechanical stress in the strip is very high at the ends of the long, line-shaped support zone of the guide cylinder. In addition, the guide cylinder has almost no correcting effect with its center zone, so that the strip is twisted locally. Moreover, the guide cylinder is lastingly forcing the strip onto the support, so that in the course of correction, the center zone of the strip acted upon for correction is clamped in an undesirable way across the entire width of the support zone, and the strip is not only braked, or slowed down, but will follow corrections unwillingly under certain circumstances. This may cause damage in the strip.

With another device known from WO-88/01755 for guiding photo printing paper web, the width of the support zone of the one-piece guide cylinder comes to about one-third of the total width of the paper strip. With such a long support zone of the guide cylinder, which is desirable for final corrections, high mechanical stresses occur at the longitudinal ends of the guide cylinder, which on the one hand may lead to damage in the strip and, on the other hand, reduce the corrective effect of the guide cylinder between its ends. Furthermore, during correction and also when running correctly, the strip is clamped between the guide cylinder and the stationary support across the width of the support zone, which means additional mechanical stress is caused in the strip and the displacement of the strip sideways during corrections is made more difficult.

With another type of a device as known from DE-A1-28 44 528 for guiding a strip of photographic paper, the strip of paper runs centrally through a roll gap of two guide cylinders which are pressed against one another, one of which is driven. The width of each guide cylinder conforms to about one-sixth of the width of the strip. For obtaining an adequate corrective effort to some degree with such short guide cylinders, it is necessary to set a highly inclined position and strong clamping, which leads to high mechanical stresses in the strip.

SUMMARY OF THE INVENTION

It is an object of the present invention to create a device for guiding a running or moving transversely stable web, by means of which wide, transversely stable webs can be guided in a careful and protective way.

The above object is accomplished in accordance with the present invention by providing a device for guiding a moving, transversely stable web, in particular a corrugated board web, a corrugated board layer web, a paper web, or a transversely stable foil web, with a stationary support for the underside of the web and a following guide cylinder placed approximately centrally on the top side of the web, said guide cylinder swinging back and forth by means of a drive around an adjusting axle disposed approximately perpendicular to the plane of the web, and being arranged stationary ahead of the guide cylinder in the moving direction of the web, wherein the guide cylinder is formed by at least two parallel, narrow guide rolls spaced apart transversely to the moving direction of the web.

The center zone to the web acted upon by the guide rolls for correction purposes is acted upon effectively and carefully, as the guide rolls apply the corrective forces with favorable lever arms with respect to the adjusting axle, while the web, however, is given the possibility of stress relieving itself between the narrow guide rolls. In the transverse direction of the web, the differences between zones of the web acted upon by higher mechanical forces, and the stress relieved zones of the web are uniformised. Furthermore, the web is capable of more favorably distributing in the intermediate space between the guide rolls the stresses introduced by the corrective action. A damaging effect of distortion with formation of folds will no longer occur. It is favorable that relatively high support pressures are possible in the narrow support zones, and that each guide roll translates its correcting inclined run almost without loss. In summary, several spaced-apart guide rolls with short support zones result in a superior and more careful guidance of the web than a through-extending guide cylinder of the same total length. When set inclined, the guide rolls can run free of slippage and at different speeds relative to one another.

A useful embodiment is wherein the freewheeling guide rolls are approximately equally spaced from a radial plane containing the adjusting axle. Both guide rolls equally contribute to the guidance. When correcting, they have a favorable lever arm relative to the adjusting axle.

Another particularly advantageous embodiment is wherein the width of each guide roll corresponds to about 30% of its diameter, and the spacing between the guide rolls approximately conforms to the diameter, with two guide rolls and with three or more guide rolls approximately equal to the width of a guide roll. In this embodiment, the relative dimensions have produced particularly good results.

In a further embodiment, the guide rolls are made of plastic material and have a smooth, non-slip circumferential surface. These materials are especially useful for paper and corrugated board webs.

A constructionally simple and functional embodiment for precisely correcting the movement of the web is wherein the guide rolls are supported on the preferably through-extending cylinder axle and maintained spaced apart by spacing elements; the cylinder axle is supported in a yoke, with the yoke swinging up and down around an axle of the yoke, whereby the yoke is parallel with the cylinder axle; and the axle of the yoke is supported by a bow, the bow pivoting around the adjusting axle by means of the drive.

In another embodiment, each guide roll is supported on its own short axle, the latter being capable of swinging up and down with a holder on the axle of the yoke and, if need be, being individually relievable or loadable. In this embodiment, the guide rolls are capable of assuming positions in height or levels independently of one another and of correcting individually.

In a further embodiment, a jib is arranged on the bow, and a loading and/or relieving device for the guide rolls is arranged between the jib and the yoke, or the holders. With this embodiment, the support pressure of the guide roll can be adjusted, or the guide rolls can be lifted from the web for threading purposes, or even when the web is running or moving correctly, if need be.

In another embodiment, the adjusting axle with the drive is arranged on a stationary bridge overgripping the web, said bridge forming a frame-like assembly with the support, the latter being embodied as a transversely extending, plane sliding surface. In this embodiment, the assembly is advantageous in terms of installation, and also permits later attachment of the device to a web processing plant in order to retrofit the latter.

A device of this type normally operates with optical edge-sensing devices; the corrective motions are derived from the signals of such devices. Particularly in the treatment of paper and cardboard webs, lint and dust occur with the undesirable tendency to deposit on stationary parts. Especially the optical edge-sensing devices suffer from such deposits. If, for correcting a web extending in the transverse direction, the guide cylinder forces the web against the stationary support, this hinders the corrective action, and longitudinal stresses are produced in the pulled web. Therefore, according to another embodiment of the invention, a careful and precise correction is assured with this embodiment. Here, this support on the side contacted by the underside of the web can be acted upon by compressed air, and provision is made for a compressed air passage to the underside of the web at least across the width of the support zone of the guide rolls.

In this embodiment, the compressed air keeps the optical edge-sensing device clean, on the one hand, and reduces the support pressure of the web. A type of air cushion can form under the web, on which the web glides smoothly both in the longitudinal and transverse directions and responds more sensitively to the corrective forces. This embodiment is therefore characterized by the fact that the spaced-apart guide rolls operate effectively, whereas the air cushion beneath the web reduces the resistance to motion of the web on the support. However, an air cushion built up under the running web offers advantages also when, for correcting the web, the top side of the latter is acted upon by a through-extending long guide cylinder, or by only one guide roll.

A further embodiment is wherein the support has at least one nozzle slot. The nozzle slot may extend across the width of the support zone of the guide rolls, or it may be wider, so that the web is acted upon by the compressed air across its total width. If the guide slot is even wider than the web, the optical edge-sensing devices on the edges of the web are kept clean.

Another embodiment is wherein the support is perforated with passages at least within the zone of the support. In this embodiment, a clean distribution of the compressed air takes place for a uniform stress relieving effect. With this embodiment, it is highly advantageous if provision for the air-distributing box is made on the underside of the support.

Finally, this embodiment is advantageous because this air-distributing box assures a steadying of the air flow and an even stress relieving of the web across a selectable range of the width. The air-distributing box may contain controlling elements for adjusting the thickness of the air cushion or the width of the zone acted upon by the compressed air.

BRIEF DESCRIPTION OF THE DRAWINGS

Other objects and features of the present invention will become apparent from the following detailed description considered in connection with the accompanying drawing which discloses several embodiments of the present invention. It should be understood, however, that the drawing is designed for the purpose of illustration only and not as a definition of the limits of the invention.

In the drawing, wherein similar reference characters denote similar elements throughout the several views.

DETAILED DESCRIPTION OF PREFERRED EMBODIMENTS

Figure 1:
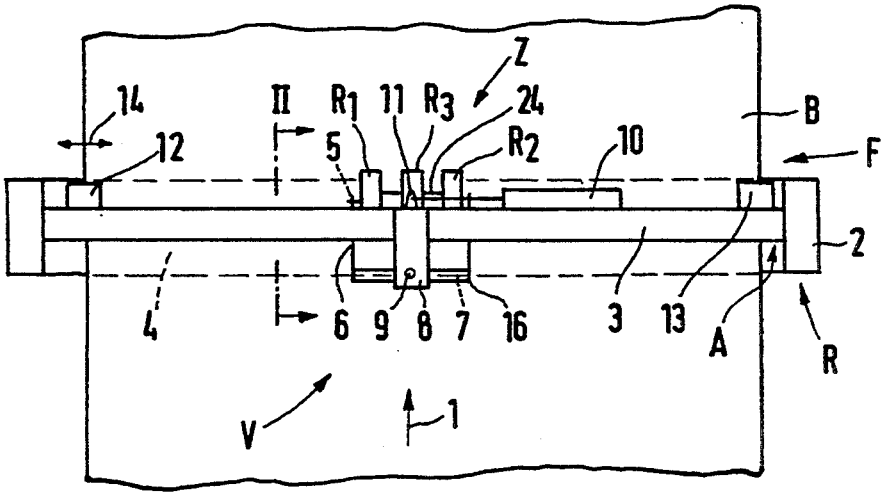
FIG. 1 is a schematic top view of a device for guiding a moving web.
Figure 2:
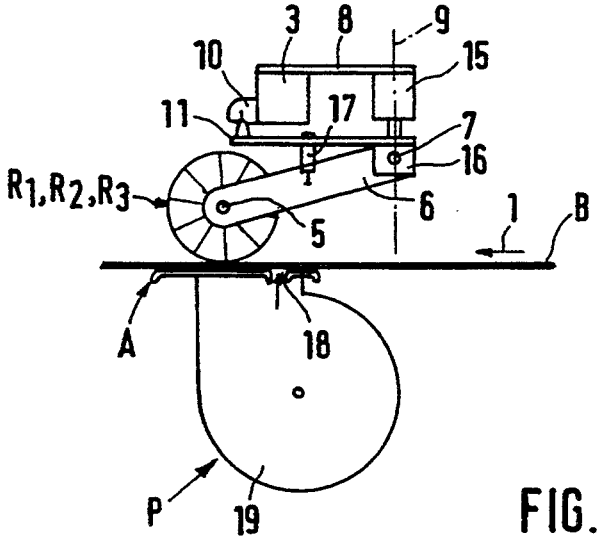
FIG. 2 shows a section along line II—II of FIG. 1.

Turning now in detail to the drawing, FIGS. 1 and 2 show a device V for guiding a moving, transversely stable web B, for example a web of paper or corrugated board, has a frame-like assembly R. This assembly is mounted in the path of movement of web B, with the latter extending through said assembly. The assembly R contains a lower support A extending crosswise therethrough and forming a plane sliding surface 4; the lateral supports 2 and a girder 3 spanning across the web B in the manner of a bridge. The web B moves in the direction indicated by the arrow 1.

At least one edge is scanned by an optical edge-sensing device F in order to determine any crosswise deviation of the web B from the nominal direction of movement, and to generate correction signals. On the girder 3, a guide cylinder Z is pivotably mounted in about the center of the web, swinging around the cylinder axle 5. In the exemplified embodiment shown, this guide cylinder is formed by three parallel and narrow guide rolls $R_1$, $R_2$, $R_3$, which are disposed side by side transversely to the movement direction 1 of the web. The cylinder axle 5 is supported in a yoke 6, which is capable of swinging up and down around a yoke axle 7. The yoke axle 7 is disposed parallel with the cylinder axle 5 and fixed in a bow 16, which is swinging back and forth around an adjusting axle 9 disposed approximately perpendicular to the plane of web B by means of a drive 10, the latter being secured on the girder 3.

The drive 10, for example, a hydraulic or pneumatic servo-cylinder or an electric servo-drive, engages a jib 11 of the bow 16. The bow 16 is rotatable in a bearing bushing 15 around the adjusting axle 9, whereby the bushing 15 is fixed by a console on the girder 3. Provision is made between the jib 11 and the yoke 6 for a loading and/or relieving device 17 for the freewheeling guide rolls $R_1$, $R_2$, $R_3$, which are supported so as to be freely rotating. Device 17 can be, for example, a small operating cylinder, a permanent magnet or electromagnet, or a spring. Provision is made for the spacing elements 24 between the guide rolls $R_1$, $R_2$, $R_3$.

The edge-sensing device F comprises the optoelectronic edge sensors 12, 13 which are adjustable for adaptation to the width of the web in the direction of the double arrows 14, and usefully mounted on the girder 3. A drive (not shown in the drawing) permits an adjustment of the sensors 12, 13 during operation. The sensors 12, 13, like the drive 10, and, if needed, the loading and/or relieving device 17, are connected to a controller (not shown), which is programmable.

The guide rolls $R_1$, $R_2$, $R_3$ rest on the top side of the web B and freely follow the web B. The contact or support pressure can be adjusted with the help of the loading and/or relieving device 17. Furthermore, the guide rolls $R_1$, $R_2$, $R_3$ can be lifted from the support A with the help of the loading and/or relieving device 17.

The support A has a nozzle slot 18, through which compressed air can be guided from the bottom against the web B by means of a pressure blower 19 representing a pressure source P. The compressed air cleans the sensing device F and relieves the web B on the support A. If need be, an air cushion is produced, permitting smooth sliding of the web B.

If the web B in FIG. 1 deviates from the normal direction of movement, the sensors 12, 13 generate a correction signal once a tolerance range is exceeded, and the drive 10 swings the guide rolls $R_1$, $R_2$, $R_3$ around the adjusting axle 9 on the basis of such a signal. The guide rolls $R_1$, $R_2$, $R_3$ induce corrective forces into the moving web B until the latter has returned to the normal direction of movement. In this process, the deflection of the guide rolls $R_1$, $R_2$, $R_3$ around the adjusting axle 9 is cancelled again.

Figure 4:
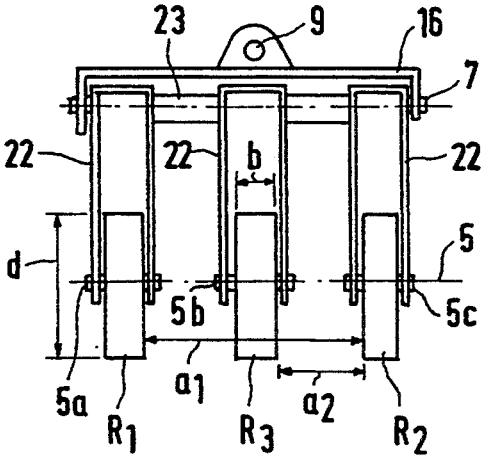
FIG. 4 shows a detailed view of a cylinder and yoke combination similar to that shown in FIG. 2.

In the embodiment according to FIG. 4, the guide rolls $R_1$, $R_2$, $R_3$ are supported on their own short axles 5*a*, 5*b*, 5*c*, respectively, which are swivel-mounted with the holders 22 on the yoke axle 7 and set spaced apart by the spacing elements 23.

As shown in FIG. 4, the width b of the guide rolls $R_1$, $R_2$, $R_3$ comes to approximately 30% of the diameter d. With three guide rolls $R_1$, $R_2$, $R_3$, the spacing $a_2$ between the rolls equals approximately the dimension of width b. However, if provision is made for only two guide rolls $R_1$ and $R_2$, the spacing $a_1$ between said rolls approximately equals the diameter d. For each holder 22, provision can be made for its own loading and/or relieving device 17 for loading and relieving.

Figure 3:
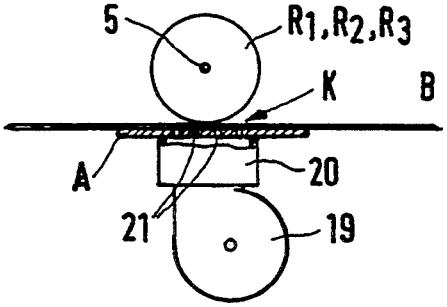
FIG. 3 is a side view of another embodiment.

With the embodiment according to FIG. 3, the support A has the perforations 21 for establishing a connection from an air-distributing box 20 on the underside to the bottom side of the web B, so that an air cushion K can be produced beneath the web B. A pressure blower 19 is connected to the air-distributing box. If necessary, the effective size of the air cushion can be varied by openings arranged in the air-distributing box beneath the support A.

The guide rolls $R_1$, $R_2$, $R_3$ can be made of plastic material and have a cylindrical circumferential surface, which is smooth and yet gripping. In view of low mass inertia, the guide rolls R are lightweight and can be provided with spokes. If necessary, the spacing elements 23 are molded as part of the former. Inside sliding bearings assure easy rotation of the guide rolls.

For stability reasons, the assembly R can be embodied with two girders 3 disposed side by side. Furthermore, loading or relieving weights conceivably could be adjustably arranged on the holders 22 in FIG. 3.

Figure 5:
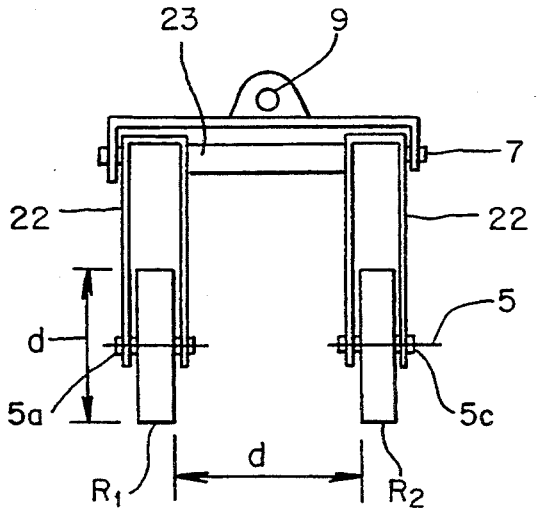
FIG. 5 shows a further embodiment wherein the guide cylinder has two parallel guide rolls.

FIG. 5 shows the further embodiment wherein the guide cylinder is formed by two parallel guide rolls R1 and R2 spaced apart transversely to the moving direction of the web, and wherein the width of each guide roll corresponds to about 30% of its diameter, and with two guide rolls, the spacing between the guide rolls approximately conforms to the diameter of the guide rolls.

While several embodiments of the present invention have been shown and described, it is to be understood that many changes and modifications may be made thereunto without departing from the spirit and scope of the invention as defined in the appended claims.

What is claimed is:

1. A device for guiding a moving, transversely stable web having an underside, a top side, a plane and a moving direction, comprising:

a stationary support for the underside of the web;

a following guide cylinder placed approximately centrally on the top side of the web, a drive means for swinging said guide cylinder back and forth around an adjusting axle disposed approximately perpendicular to the plane of the web, and being arranged stationary ahead of the guide cylinder in the moving direction of the web;

wherein the guide cylinder is formed by at least two parallel guide rolls spaced apart transversely to the moving direction of the web;

wherein the guide rolls are each supported on a through-extending cylinder axle and maintained spaced apart by at least one spacing element;

the cylinder axle is supported in a yoke, said yoke swinging up and down around an axle of the yoke, whereby the yoke axle is parallel with the cylinder axle;

the axle of the yolk is supported by a bow, said bow pivoting around an adjusting axle by means of a bearing bushing; and wherein each guide roll is supported on its own guide roll axle; means enabling said guide roll axle to be capable of swinging up and down with a holder on the axle of the yoke.

2. Device as defined in claim 1, wherein the guide rolls are freewheeling and approximately equally spaced from a radial plane containing the adjusting axle.

3. Device as defined in claim 1, wherein the guide rolls are made of plastic material and have a smooth, non-slip circumferential surface.

4. Device as defined in claim 1, wherein a jib is arranged on the bow; and a loading and relieving device for the guide rolls is arranged between the jib and the yoke.

5. Device as defined in claim 1, wherein the adjusting axle with the drive is arranged on a stationary bridge overgripping the web, said bridge forming a frame-like assembly with the support, the support being embodied as a transversely-extending, plane sliding surface.

6. Device as defined in claim 5, wherein the support on the side adjacent to the underside of the web can be acted upon by compressed air; and further comprising means for providing a compressed air passage to the underside of the web at least across the width of the support zone of the guide rolls.

7. Device as defined in claim 6, wherein the support has at least one nozzle slot.

8. Device as defined in claim 5, wherein the support is perforated with passages at least within the zone of the support.

9. Device as defined in claim 1, wherein said guide cylinder is formed by two parallel guide rolls spaced apart transversely to the moving direction of the web, and wherein the width of each guide roll corresponds to about 30% of its diameter, and with the spacing between said two guide rolls approximately conforming to the diameter of said guide rolls; and said guide rolls being freely rotatable independently from each other.

10. Device as defined in claim 1, wherein said guide cylinder is formed by at least three parallel guide rolls spaced apart transversely to the moving direction of the web, and wherein the width of each guide roll corresponds to about 30% of its diameter, and with said at least three parallel rolls the spacing between the said guide rolls is approximately equal to the width of said guide roll; and said guide rolls being freely rotatable independently from each other.

* * * * *